US005698321A

United States Patent [19]

Selivansky

[11] Patent Number: 5,698,321

[45] Date of Patent: Dec. 16, 1997

[54] ACRLIC-COVERED SPANDEX YARN

[76] Inventor: Dror Selivansky, 65 Hantke Street, 34608 Haifa, Israel

[21] Appl. No.: 677,656

[22] Filed: Jul. 8, 1996

[51] Int. Cl.[6] ..... D02G 3/00

[52] U.S. Cl. ..... 428/373; 428/364; 428/377; 428/394; 57/210; 57/225; 57/3; 442/184; 442/197; 442/199; 442/306; 442/310; 442/311

[58] Field of Search ..... 428/364, 378, 428/377, 394, 373; 442/182, 184, 197, 199, 306, 310, 311; 57/207, 210, 225, 3, 10

[56] References Cited

U.S. PATENT DOCUMENTS 4,663,232 5/1987 Kamide et al. .
4,668,563 5/1987 Buese et al. ..... 428/230
4,873,142 10/1989 Bach .
4,879,169 11/1989 Zafiroglu ..... 428/230
5,335,517 8/1994 Throneburg et al. ..... 65/185

FOREIGN PATENT DOCUMENTS 1055419 1/1967 United Kingdom .

*Primary Examiner*—Patrick Ryan
*Assistant Examiner*—J. M. Gray
*Attorney, Agent, or Firm*—Mark M. Friedman

[57] ABSTRACT

An acrylic-covered spandex yarn, a method for producing the same, and textiles and garments made from the same. Specially modified acrylic yarn is substituted for nylon yarn in a conventional process for making nylon-covered spandex. Surprisingly, the process parameters are substantially the same as for nylon yarn, despite the inferior flex fatigue resistance and abrasion resistance of the acrylic yarn compared to those of the nylon yarn.

10 Claims, No Drawings

ACRLIC-COVERED SPANDEX YARN

FIELD AND BACKGROUND OF THE INVENTION

The present invention relates to yarns made of synthetic fibers and, more particularly, to spandex yarn covered with acrylic yarn.

Spandex is an elastomeric fiber that is commonly used in high quality apparel and hosiery. In that application, the spandex yarn commonly is covered with yarn of a different fiber because bare spandex feels sticky, breaks frequently during processing, and is hard to dye. Conventionally, nylon yarn is used to cover spandex because of nylon's superior flex fatigue resistance and abrasion resistance.

Acrylic fiber is superior to nylon fiber in respects other than flex fatigue and abrasion resistance. For example, acrylic fiber feels much more like silk than does nylon fiber. This gives fabrics made of acrylic fiber a softness, coolness, and lightness not available with nylon. Acrylic fabrics are smoother and more pliant than nylon fabrics. Acrylic fabrics absorb more moisture and wick better than nylon fabrics. Acrylic fibers, yarns and fabrics can be dyed faster than nylon fibers, yarns and fabrics, and the resulting colored acrylic fibers, yarns and fabrics have more brilliant colors and a higher luster than the corresponding nylon fibers, yarns and fabrics, as well as having better light fastness. Acrylic fabrics dry faster than nylon fabrics, and are more suitable for use in wash-and-wear garments.

In addition to these advantages, acrylic yarn has other advantages over nylon as a cover for spandex yarn. Acrylic fiber has a higher denier per filament, and a higher denier, than nylon yarn, for covered yarn of equivalent aesthetic quality and handle. Acrylic yarn develops a higher shrinkage force than nylon yarn. Therefore, acrylic yarn grips the spandex core better than nylon yarn. Accordingly, a lower covering frequency can be used with acrylic yarn than with nylon yarn, and a single cover of acrylic yarn can be used in place of a double cover of nylon yarn. In addition, the shrinkage of acrylic yarn can be adjusted to between about 1% and about 15%, unlike nylon yarn, whose shrinkage is between about 3% and about 5%. This is particularly useful if the spandex is wrapped using an air jet process: the higher shrinkage of acrylic yarn can be used to offset the relatively loose coverage obtained using that process.

There is thus a widely recognized need for, and it would be highly advantageous to have, a spandex yarn covered with acrylic yarn having flex fatigue resistance and abrasion resistance similar to that of nylon.

SUMMARY OF THE INVENTION

According to the present invention there is provided an article of manufacture, comprising: (a) a spandex yarn; and (b) a continuous acrylic yarn covering the spandex yarn, the acrylic yarn having a denier of between about 10 and about 110.

According to the present invention there is provided a method for covering spandex yarn with acrylic yarn, comprising the step of wrapping the acrylic yarn around the spandex yarn.

According to the present invention there is provided an article of manufacture, comprising at least one covered yarn including: (a) a spandex yarn; and (b) a continuous acrylic yarn covering the spandex yarn, the acrylic yarn having a denier of between about 10 and about 110.

Bach, in U.S. Pat. No. 4,873,142, and Kamide et al., in U.S. Pat. No. 4,663,232, which patents are incorporated by reference for all purposes as if fully set forth herein, teach the production of acrylic fibers having flex fatigue resistance and abrasion resistance in the range of those of nylon fibers. Specifically, Bach's acrylic fibers have 50% to 80% of the flex fatigue resistance and abrasion resistance of nylon fibers. However, both Bach and Kamide et al. teach away from the use of their fibers in applications, such as covering spandex, in which the yarn is thousands of meters long. The applications envisioned by Bach are those, such as men's socks, in which the acrylic fiber is used in the form of staple. The application cited by Kamide et al. is a carpet having a cut pile length of 10 millimeters. The present invention uses continuous yarn made of Bach's acrylic fibers, where continuous means indefinitely long, to cover spandex yarn. As a practical matter, the length of the yarn is inevitably constrained by circumstances of manufacture extraneous to the invention itself, such as accidental breaks in the yarn, or such as scheduled interruptions for yarn spool changes or for maintenance of the machinery; but the present invention itself places no upper limit on the length of the acrylic yarn.

The improved flex fatigue resistance and abrasion resistance of Bach's acrylic fibers gives them two advantages over conventional acrylic fibers in covering spandex. First, the covering process is more efficient, having fewer breaks per kilogram of produced covered yarn. Second, the covered yarns themselves, and the garments made therefrom, have better wear life and abrasion resistance.

The superior softness and luster of the acrylic yarn of the present invention allows the use of yarn of a higher denier and a higher denier per filament than that which would be required to produce a covered yarn of similar aesthetic and handle properties using nylon. Alternatively, covered yarn of higher aesthetic quality is obtained by substituting acrylic yarn for nylon yarn of the same denier and denier per filament. The following denier/filament number ranges are included in the scope of the present invention for the garment types listed:

| | |
|---|---|
| women's pantyhose (hose part): | 10/4–22/7 |
| women's pantyhose (panty part): | 33/10–110/34 |
| men's socks: | 70/23–110/34 |
| general apparel: | 33/10–110/34 |

In the above list, the number to the left of the "/" is the denier of the yarn and the number to the right of the "/" is the number of filaments in the yarn. General apparel includes women's knitwear, men's sweaters, men's shirts, and men's cardigans. Aesthetically equivalent nylon-covered yarn has a denier about half of those listed.

The scope of the present invention also includes textiles and garments made from spandex yarn covered by acrylic yarn, including both woven textiles and garments, and knitted textiles and garments.

DESCRIPTION OF THE PREFERRED EMBODIMENTS

The present invention is of spandex yarn covered with acrylic yarn having flex fatigue resistance and abrasion resistance in the range of the flex fatigue resistance and abrasion resistance of nylon. Specifically, the present invention can be used to manufacture apparel having the superior aesthetic properties of acrylic yarn while retaining the superior mechanical properties of nylon.

The acrylic-covered spandex yarn of the present invention is made by substituting acrylic yarn for nylon yarn in a conventional process for making nylon-covered spandex yarn by wrapping nylon yarn around spandex yarn. There are two such processes in common use, hollow spindle covering and air jet covering. In hollow spindle covering, the covering yarn is spooled around a spool with a hollow center. The spandex yarn is drawn through the hollow center of the spool while the covering yarn is wrapped around it. In air jet covering, the covering yarn is blown around the spandex yarn by a turbulent spiral air jet. Air jet covering is much faster than hollow spindle covering, but produces a covered yarn with looser covering. Surprisingly, substantially the same process parameters are used for acrylic yarn as are used for nylon yarn, despite the slightly inferior flex fatigue and abrasion resistance of Bach's acrylic fibers as compared to nylon fibers:

1. Nylon-covered spandex can have a yarn covering frequency of up to 2000 turns per meter. According to the present invention, the yarn covering frequency of acrylic-covered spandex is between about 200 turns per meter and about 2000 turns per meter. Because the acrylic yarn has higher denier and higher shrinkage force than the nylon yarn it replaces, the resulting acrylic-covered spandex of a specific covering frequency has the same aesthetic quality as the equivalent nylon-covered spandex of a higher covering frequency.

2. In hollow spindle covering, the spooling speed, that is, the speed at which the covering yarn is wound around the spool, is in the same range as for nylon: between about 5000 meters per minute and about 10,000 meters per minute.

3. In air jet covering, substantially the same operating parameters are used as are used with nylon. The air pressure is between about 4 bar and about 14 bar; the take-up speed is between about 50 meters per minute and about 800 meters per minute; and the cover yarn overfeed is between about 30% and about 150%.

Subsequent processing of the acrylic-covered spandex of the present invention is conventional. Standard weft knitting procedures may be used, as are used for nylon-covered spandex, either the four feed covered yarn procedure, in which four covered spandex yarns are knitted together, or the alternate two feed covered/uncovered procedure, in which two covered spandex yarns are knitted together with two textured yarns. Standard warp knitting procedures may include combinations of the acrylic-covered yarn with acrylic yarn, nylon yarn, cotton yarn, wool yarn, polyester yarn, etc.

The acrylic-covered yarn of the present invention, and fabrics knitted therefrom, are dyed by standard methods for dyeing acrylic fabrics and acrylic blend fabrics. Knits of pure acrylic-covered spandex are dyed with basic (cationic) dyestuff. Blends of acrylic-covered spandex and nylon textured yarns are dyed with both basic (cationic) dyestuff and acidic (anionic) dyestuff, in the same dyebath. Disperse and anionic dyes may be matched for universal dyeing of both acrylic-covered spandex and nylon-covered spandex. Because the acrylic-covered spandex of the present invention has hot-wet mechanical properties, particularly modulus, that are inferior to those of nylon-covered spandex, acrylic-covered spandex knits must be dyed free of mechanical stresses, to avoid shape distortion.

While the invention has been described with respect to a limited number of embodiments, it will be appreciated that many variations, modifications and other applications of the invention may be made.

What is claimed is:

1. An article of manufacture, comprising:

(a) a spandex yarn; and (b) a continuous filament acrylic yarn covering said spandex yarn, said acrylic yarn having a denier of between about 10 and about 110.

2. The article of manufacture of claim 1, wherein said acrylic yarn is characterized by a covering frequency of between about 200 turns per meter and about 2000 turns per meter.

3. A method for covering spandex yarn with continuous filament acrylic yarn, comprising the step of wrapping the continuous filament acrylic yarn around the spandex yarn.

4. The method of claim 3, wherein the acrylic yarn is characterized by a denier of between about 10 and about 110.

5. The method of claim 3, wherein the spandex yarn is covered by the acrylic yarn at a yarn covering frequency of between about 200 turns per meter and about 2000 turns per meter.

6. The method of claim 3, further comprising the step of spooling the acrylic yarn at a speed of between about 5000 meters per minute and about 10,000 meters per minute.

7. The method of claim 3, wherein said step of wrapping the acrylic yarn around the spandex yarn is effected using an air jet characterized by an air jet pressure, a take-up speed, and a cover yarn overfeed, the method further comprising the steps of:

(a) setting said air jet pressure to between about 4 bar and about 14 bar;

(b) setting said take-up speed to between about 50 meters per minute and about 800 meters per minute; and (c) setting said cover yarn overfeed to between about 30% and about 150%.

8. An article of manufacture, comprising at least one covered yarn including:

(a) a spandex yarn; and (b) a continuous filament acrylic yarn covering said spandex yarn, said acrylic yarn having a denier of between about 10 and about 110.

9. The article of manufacture of claim 8, wherein at least part of the article of manufacture is woven from said covered yarn.

10. The article of manufacture of claim 8, wherein at least part of the article of manufacture is knitted from said covered yarn.

* * * * *

UNITED STATES PATENT AND TRADEMARK OFFICE

CERTIFICATE OF CORRECTION

PATENT NO. : 5,698,321

DATED : Dec. 16, 1997

INVENTOR(S) : Dror Selivansky

It is certified that error appears in the above-identified patent and that said Letters Patent is hereby corrected as shown below:

On the title page, and in column 1, line 1:

- In the title, correct the spelling of the word, "ACRYLIC".

Signed and Sealed this

Twenty-fourth Day of February, 1998

*Attest:*

Bruce Lehman

BRUCE LEHMAN

*Attesting Officer*

*Commissioner of Patents and Trademarks*